US008215524B1

(12) United States Patent
Swisher

(10) Patent No.: US 8,215,524 B1
(45) Date of Patent: Jul. 10, 2012

(54) DEVICE FOR PULLING ON AND REMOVING SOCKS

(75) Inventor: Steven L. Swisher, Broken Arrow, OK (US)

(73) Assignee: Richard Trent Morris, Tulsa, OK (US)

( * ) Notice: Subject to any disclaimer, the term of this patent is extended or adjusted under 35 U.S.C. 154(b) by 273 days.

(21) Appl. No.: 12/504,398

(22) Filed: Jul. 16, 2009

(51) Int. Cl.
*A47G 25/80* (2006.01)

(52) U.S. Cl. ..... 223/111

(58) Field of Classification Search ..... 223/111–119
See application file for complete search history.

(56) References Cited

U.S. PATENT DOCUMENTS

| | | | | |
|---|---|---|---|---|
| 2,443,115 | A * | 6/1948 | Park | 223/111 |
| 2,903,170 | A * | 9/1959 | Ahn | 223/111 |
| 3,591,226 | A * | 7/1971 | Elmore et al. | 294/19.1 |
| 3,604,604 | A * | 9/1971 | Ahn | 223/111 |
| 4,066,194 | A | 1/1978 | Leland | |
| 4,238,061 | A | 12/1980 | Marchetti et al. | |
| 4,620,737 | A | 11/1986 | Sanger | |
| 5,065,917 | A | 11/1991 | Diehm | |
| 5,322,199 | A | 6/1994 | White | |
| 5,392,800 | A * | 2/1995 | Sergi | 135/65 |
| 5,513,783 | A | 5/1996 | White | |
| 5,630,534 | A | 5/1997 | Maier et al. | |
| 5,636,774 | A | 6/1997 | Moscato | |
| 5,706,988 | A * | 1/1998 | Moore | 223/111 |
| 5,894,970 | A | 4/1999 | Belkin et al. | |
| 5,924,610 | A * | 7/1999 | Willemin | 223/112 |
| 6,942,129 | B2 * | 9/2005 | Ferraioli | 223/113 |
| 6,951,224 | B2 * | 10/2005 | Garrett | 135/66 |
| 7,287,675 | B1 * | 10/2007 | Sullivan et al. | 223/111 |
| 7,364,056 | B2 * | 4/2008 | Boaron | 223/111 |
| 2009/0272772 | A1 * | 11/2009 | Sullivan et al. | 223/112 |

* cited by examiner

*Primary Examiner* — Shaun R Hurley
*Assistant Examiner* — Andrew Sutton
(74) *Attorney, Agent, or Firm* — Molly D. McKay

(57) ABSTRACT

A mechanical device for pulling on and removing socks which does not require any excessive bending or other extraneous body movement by the user. The device is primarily comprised of a triangular shaped sock mount attached to one end of an elongated shaft that terminates on a second end in a u-shaped handle containing hand operative controls. By engaging the hand operative controls the device can secure a sock to the sock mount while the user places their foot inside the sock. Disengaging the controls allows the user to remove the device from the sock while keeping their foot inside and enables the sock mount to rotate 180 degrees to expose the stationary elevated tongue that can then be used to remove the sock from the user's foot, can be used as a shoe horn, or to place the device in a storage position.

11 Claims, 4 Drawing Sheets

DEVICE FOR PULLING ON AND REMOVING SOCKS

BACKGROUND OF THE INVENTION

1. Field of the Invention

The present invention relates to a mechanical device that aids the user in putting on and removing socks. By providing an elongated shaft and hand operative means of gripping and releasing the sock, the device allows for the putting on and removing of the sock without requiring any excessive bending or other extraneous body movement by the user.

2. Description of the Related Art

Various devices have been employed to aid people that face difficulty when attempting to put on or remove socks. People may find this particular activity difficult due to obesity, back problems, arthritis, or temporary conditions such as pregnancy or recovering from surgery. The activity of putting on socks contains several smaller tasks that, upon individual examination, can be seen as difficult for many suffering from any of the above mentioned conditions. The donning of a sock requires three major steps, stretching the sock beyond its normal proportions, lining up and inserting the foot into the sock, and pulling the sock over the user's foot, ankle, and beyond. Previous devices have provided a mount for a sock, aiding in the second and third steps of the process. However, a device which solely provides a mount for a sock still requires a significant amount of grip strength to stretch the sock and fails to aid the user in pulling the sock over the user's foot without requiring additional, possibly difficult, body movement.

The present invention addresses these issues by providing a flexible frame on which to initially mount the sock and by providing an elongated shaft that connects the sock mount to the hand operative controls, eliminating the need for the user to bend over at any point to manipulate the sock. The flexible frame on the distal end of the device aids the user in stretching the sock beyond its original proportions. By providing a triangular sock mount with a narrow tip, the device allows the user to increase the dimensions of the sock incrementally, without requiring that the user maintain a specific level of tension to increase the dimensions of the sock. On the rear of the sock mount, two tabs exist on each side of the sock mount. The two tabs curve vertically from the base of the sock mount and are ultimately perpendicular to the sock mount. These two tabs further facilitate the vertical stretching of the sock, aid in holding the sock on the sock mount, and aid in the second step of donning a sock by providing side rails for the user to slide their foot along when inserting their foot into the sock.

The present invention also alleviates problems in the third step of donning a sock by providing an elongated shaft terminating in hand operative controls. The elongated shaft allows the user to place the sock onto the sock mount and then, without requiring any excessive bending or other body movement, position the sock mount below their foot. Inside the handle of the device is a grip that operates a toothed clamp located behind the sock mount. With minimal grip strength, the grip can be engaged inward to lock the sock on the sock mount in place. With the jaw engaged, the user can easily pull the device towards them, completely the process of donning a sock without requiring a significant amount of grip strength or without maintaining a high level of tension across the sock.

The device can also be employed to remove socks from a person's foot. The sock is retained on the device after it is removed from the foot so that the person does not have to bend or stoop over to remove the sock from the foot or to retrieve the sock after it is removed.

Further, the device can be used as a shoe horn to assist in inserting a foot into a shoe.

SUMMARY OF THE INVENTION

The present invention is a mechanical device designed to aid in the putting on and removing of socks. The device consists of three main sections. A flexible sock mount is provided on the distal end of a shaft of the device. The flexible sock mount is movable and capable of rotating 180 degrees relative to the distal end of the device in order to facilitate sock removal and to place the device is a storage position when it is not in use. The sock mount is operatively connected to the distal end of the hollow, elongated shaft. A handle containing hand operative controls is provided on the opposite or proximal end of the shaft and is connected via an internal shaft that runs through the hollow outer shaft to the sock mount as a means of controlling the movement and position of the sock mount at the other end of the device.

To put on a sock, the user must first fit the sock over the flexible sock mount. Tabs provided on the sock mount hold the sock on the sock mount. Once the sock is in place, the user engages the grip controls and moves the grip inward towards the fixed base of the handle. When the grip is engaged inward, the sock mount is pulled slightly upward and is wedged under a toothed clamp which sits below the sock mount. While the sock mount is wedged below the toothed clamp the sock will be held in place. Then the user must put their foot inside the sock, while maintaining the engaged inward position of the grip. Once the foot is inside the sock, the handle grip is released, which loosens the hold the toothed clamp has on the sock. After the sock is freed from the toothed clamp, the sock itself will be released from the device so that the user may pull the device upward out of the sock, resulting in the sock remaining on the foot of the user after the device is removed.

To remove a sock, the grip handle must be engaged away from the fixed base of the handle thereby causing the sock mount to move in a distal direction and rotate 180 degrees at the distal end of the device, leaving only a raised tongue protruding from the front of the device. After the sock mount has been thus rotated to the opposite or back side of the device, the tongue is inserted between the top of the sock and the leg of the user. The device is then pushed downward towards the foot of the user, removing the sock from the foot of the user.

Alternately, the tongue can be used as a shoe horn to assist in inserting a foot into a shoe.

DETAILED DESCRIPTION OF THE PREFERRED EMBODIMENT

Figure 2:
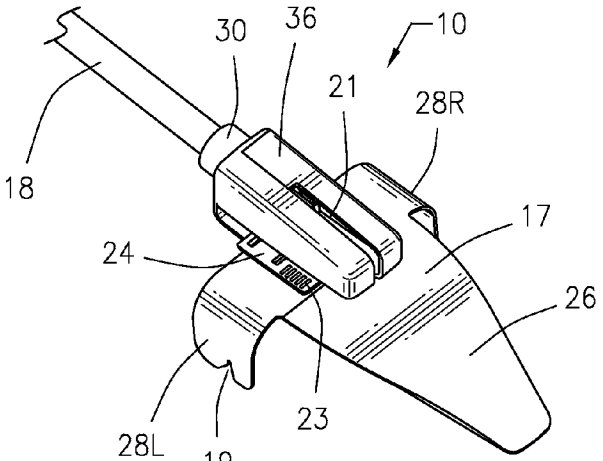
FIG. 2 is perspective view of the bottom or underside of the device of FIG. 1.
Figure 1:
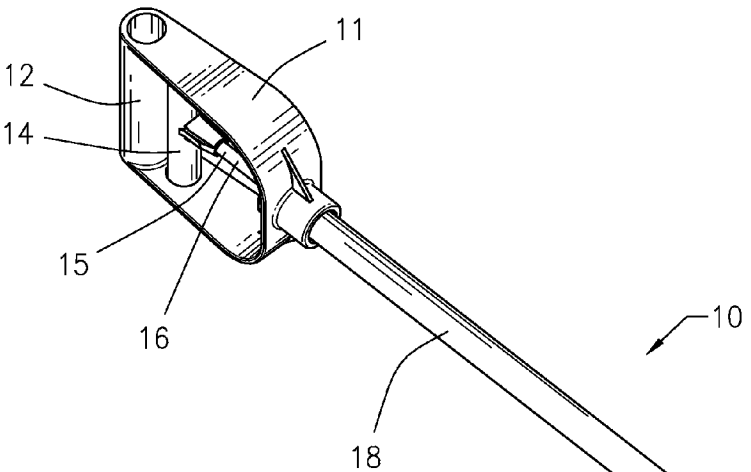
FIG. 1 is a perspective view of the top of a device constructed in accordance with a preferred embodiment of the present invention.
Figure 1:
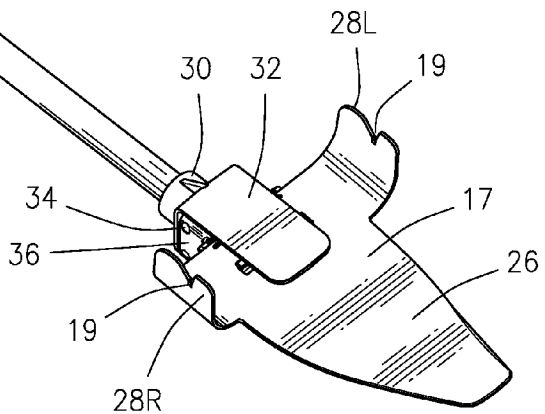
Figure 3:
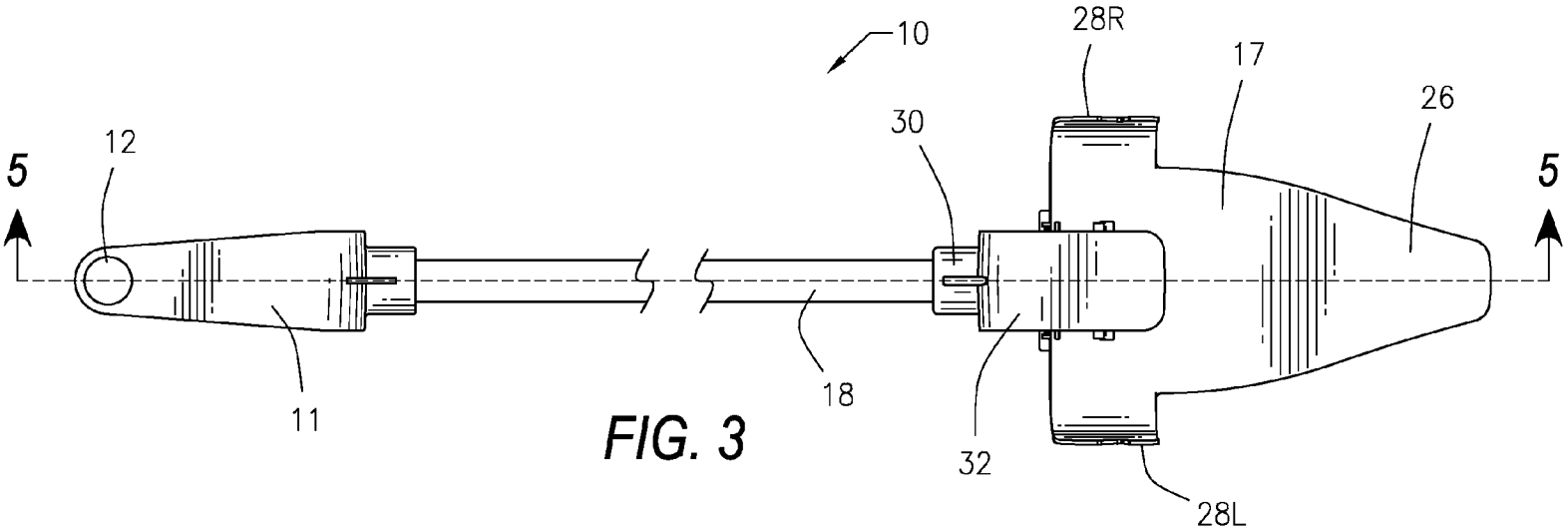
FIG. 3 is bottom plan view of the device of FIG. 1.
Figure 4:
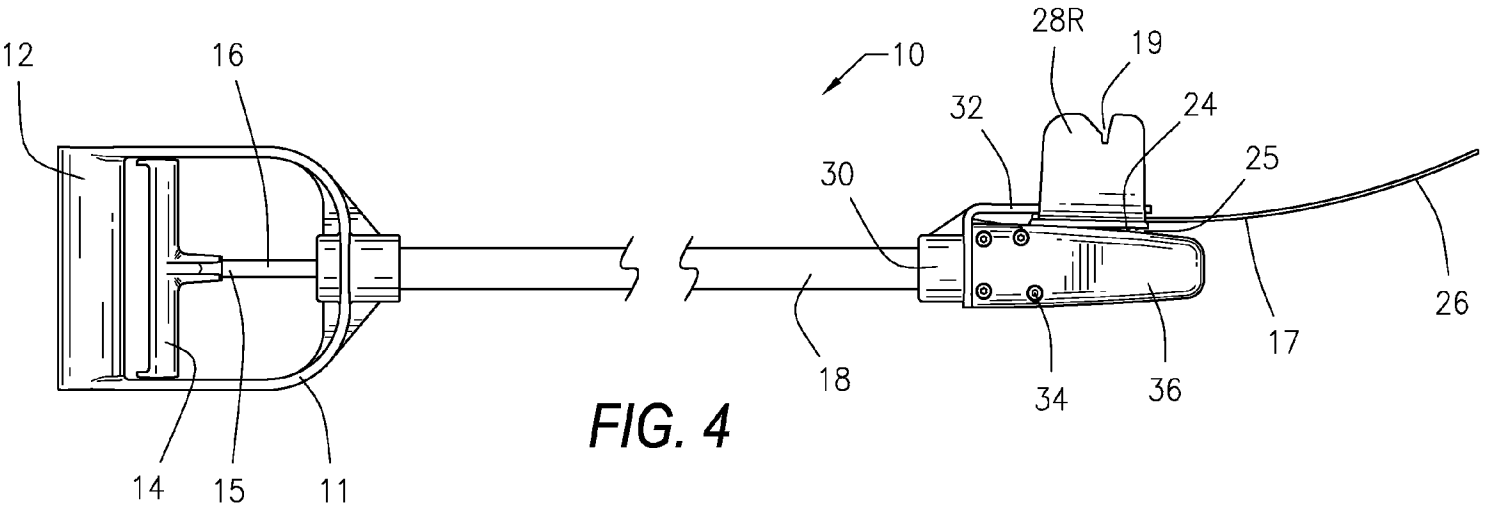
FIG. 4 is right side elevation of the device of FIG. 1.

Referring now to the drawings and initially to FIG. 1, there is shown a device 10 for pulling on socks 38 that is constructed in accordance with a preferred embodiment of the present invention. The device 10 is provided with a triangular sock mount 26 that connects on a distal end 13 of an outer elongated shaft 18 via a socket 30. On the opposite proximal end 15 of the outer elongated shaft 18 is attached a u-shaped handle 11 of the device 10 which terminates in a cylindrical base 12. Inside u-shaped handle 11 is a longitudinally movable cylindrical inner grip 14 which is positioned parallel to the base 12 and provides the hand operation of the device 10. Connected to the inner grip 14 is an inner elongated shaft 16 that extends through the hollow elongated shaft and pivotally secures to a sock mount 26 provided on the distal end 13. The inner elongated shaft 16 is smaller in diameter than the outer elongated shaft 18 so that it can move longitudinally back and forth within the outer elongated shaft 18 in response to the longitudinal movement of the grip 14.

Referring now to FIGS. 2, 3, 4, and 5A, the outer elongated shaft 18 is connected to the rectangular enclosure 36 by means of a socket 30. The rectangular enclosure 36 is provided with a raised tongue 32 that extends distally from the socket 30 so that a gap 25 is formed between the rectangular enclosure 36 and the tongue 32, with the gap 25 becoming gradually smaller at its proximal end.

It may be desirable to form the tongue 32 in a longer and narrower configuration than that illustrated in the drawings so that the tongue 32 is more easily used by persons with smaller feet, such as for example the foot 40 of a woman or child.

The rectangular enclosure 36 consists of two identical sides held together by screws 34 and conceals the pivotal connection between the sock mount 26 and the distal end 13 of the inner elongated shaft 16 that allows for rotation of the sock mount 26 around the distal end of the device 10, as will be more fully described hereafter. A tongue 32 extends distally and is raised slightly above the rectangular enclosure 36. The sock mount 26 is initially located in the gap 25 existing between the tongue 32 and the rectangular enclosure 36.

The proximal end of the sock mount 26, i.e. the end closest to socket 30, is the widest point of the sock mount 26. On each side of the sock mount 26 exists a tab 28L and 28R, which curves up from the base 17 of the sock mount 26 until the tabs 28L and 28R are approximately perpendicular to the base 17 of the sock mount 26. A notch 19 is cut out of the top of each tab 28L and 28R so that the notches 19 extend towards the rectangular enclosure 36. The sock mount 26 is somewhat flexible so that the tabs 28L and 28R are able to flex inward to facilitate placing a sock 38 over the sock mount 26. It is the sock mount 26 that holds the sock 38 open so that the user's foot 40 can be inserted into the sock 38.

Inside the rectangular enclosure 36, the distal end 13 of the inner elongated shaft 16 connects to a u-shaped knuckle 20. A pin 22 is inserted between the two ends of the u-shaped knuckle 20 to pivotally capture a proximal end of the toothed clamp 24 therebetween. The toothed clamp 24 extends through a slit 21 provided between the two halves of the rectangular enclosure 36 and, as previously described, is pivotally connected to the pin 22. The slit 21 extends from the front to the back by pivoting around the end of the rectangular enclosure 36. Small wedges 23 are provided on the inner side of the toothed clamp 24 so that the wedges 23 face towards the handle 11 of the device 10. The tooth clamp 24 is secured to the back of the sock mount 26.

Figures 5A, 5B, 5C:
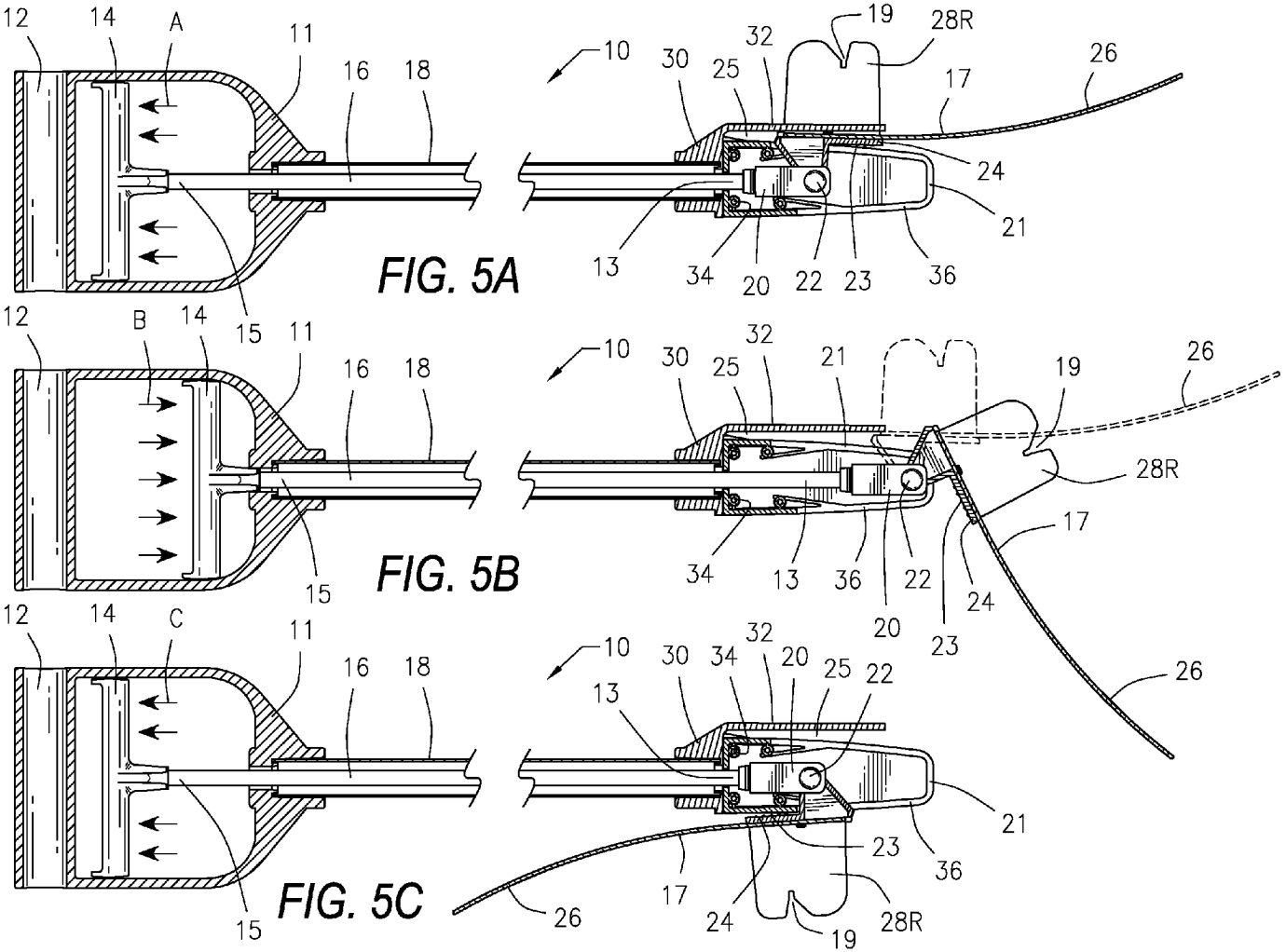
FIG. 5A is a cross sectional view taken along line 5-5 in FIG. 3 while the device is in an initial position for putting on socks. For clarity, the sock is not shown.
FIG. 5B is a cross sectional view of the device of FIG. 5A showing the device rotating from its initial position as shown in FIG. 5A, and before it rests in the final position as shown in FIG. 5C.
FIG. 5C is a cross sectional view of the device of FIGS. 5A and 5B showing the device in its final position for the removal of socks.
Figure 6:
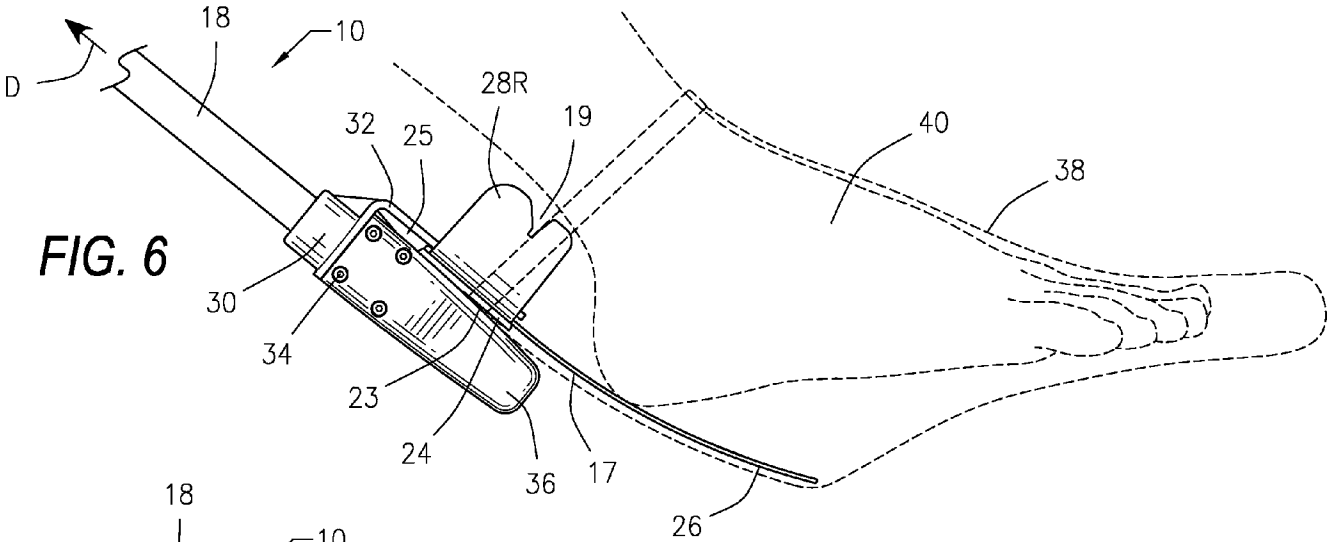
FIG. 6 is right side elevation of the device showing an attached sock in outline as the device is being used to pull the sock onto a user's foot.
Figure 7:
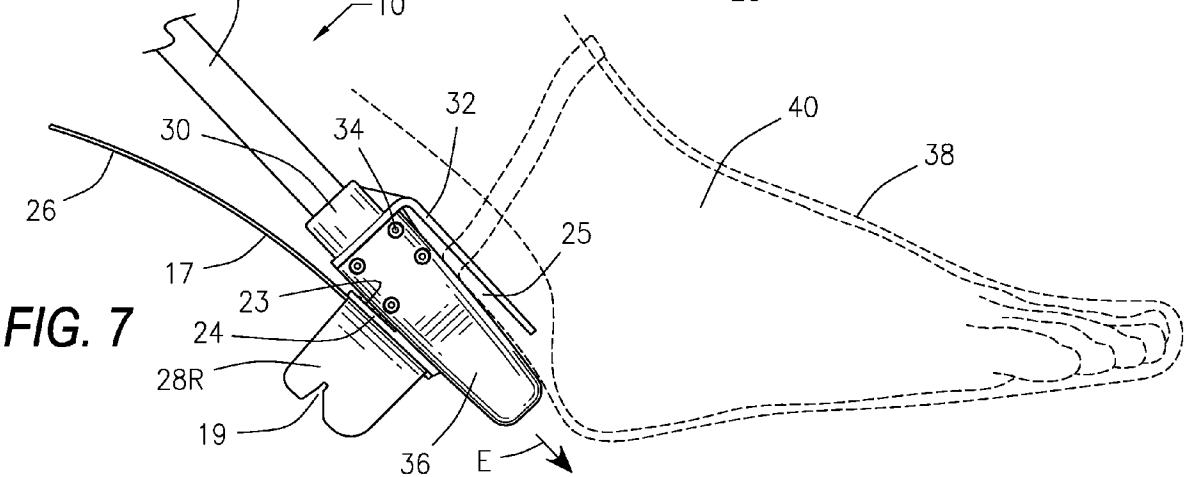
FIG. 7 is a right side elevation of the device showing an attached sock in outline as the device is being used to remove the sock from the user's foot.

Referring now to FIGS. 6 and 7, when putting on a sock 38, the sock 38 is first inserted over the curved tabs 28L and 28R of sock mount 26 and over toothed clamp 24, engaging the sock 38 in the notches 19 of the tabs 28L and 28R. Then, the grip 14 is pulled toward the handle 11, as shown by the Arrows A in FIG. 5A, so as to pull the sock 38 and sock mount 26 upward, wedging them in the gap 25 between the tongue 32 and the rectangular enclosure 36. The wedges 23 provided on the toothed clamp 24 help to hold the sock 38 on the sock mount 26. By moving the device 10 in the direction shown by Arrow D in FIG. 6, the foot the user 40 is next inserted between the two curved tabs 28L and 28R until the foot of the user 40 is fully inserted in the sock 38. Once the foot 40 is in the sock 38, the grip 14 is released, allowing the inner shaft 16 and the attached toothed clamp 24 and sock mount 26 to move as shown in FIG. 5B, releasing the sock 38 from its wedged engagement between the toothed clamp 24 and the rectangular enclosure 36. After the sock 38 is released, the device 10 can be lifted upward in the direction of Arrow D in FIG. 6 to remove the device 10 completely from the sock 38 which now is located on the user's foot 40.

To remove the sock 38 from the foot 40, the grip 14 is moved to its most distal position, as shown by Arrows B in FIG. 5B, allowing the sock mount 26 to rotate around the rectangular enclosure 36, as illustrated in FIGS. 5B and 5C. When in the position shown in FIG. 5C, the grip 14 is again moved in the direction of Arrows C. In this position, the raised tongue 32 is the only element existing above the rectangular box 36. The raised tongue 32 is then inserted between the foot 40 of the user and the sock 38 and the device 10 is pushed downward to push the sock 38 off the foot 40, as shown by Arrow E. The sock 38 is wedged on the device 10 when the sock 38 is removed from the foot 40 and is retained on the device 10 after the sock 38 is removed from the foot 40. Thus, a person does not have to bend or stoop over to remove the sock 38 from the foot 40 or to retrieve the sock 38 from the floor after the sock 38 is removed from the foot 40.

Further, in the position shown in FIG. 5C, the tongue 32 of the device 10 can alternately be used as a shoe horn to assist in inserting a foot 40 into a shoe (not illustrated).

The position shown in FIG. 5C is also a preferred storage position for the device 10 when it is not in use.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for pulling on and removing socks comprising:

a shaft with a distal end and a proximal end, a flexible sock mount movably connecting on the distal end of the shaft, said sock mount movable longitudinally relative to the distal end of the shaft, said sock mount pivotal 180 degrees relative to the distal end of the shaft, a handle with a fixed base provided on the proximal end of the shaft, and a hand operative control extending between the proximal and distal ends of the shaft for controlling movement of the sock mount.

2. A device for pulling on and removing socks according to claim 1 wherein said sock mount further comprises:

a base, an upwardly curving tab provided on each side of the base so that the tabs extend approximately perpendicular to the base, and each tab provided with a notch cut in the top of the tab as a means for retaining a sock on the base.

3. A device for pulling on and removing socks according to claim 1 further comprising:

a grip movably attached to said hand operative control and located adjacent said handle, and said grip movable between three positions.

4. A device for pulling on and removing socks comprising:

a shaft with a distal end and a proximal end, a flexible sock mount movably connecting on the distal end of the shaft so that the sock mount moves longitudinally and pivotally relative to the distal end of the shaft, a handle with a fixed base provided on the proximal end of the shaft, and a hand operative control extending between the proximal and distal ends of the shaft for controlling movement of the sock mount, a grip movably attached to said hand operative control and located adjacent said handle, and said grip movable between three positions, and a first position where the grip is moved fully toward the fixed handle which results in wedging the sock mount and any sock placed thereon between a tongue and a rectangular enclosure which are attached at the distal end of the shaft to thereby prepare the sock for placement on the user's foot, a second position where the grip is moved approximately half way between the first and third positions to a neutral disengaged position where the sock and sock mount are released from their wedged engagement between the tongue and the rectangular enclosure so that the sock can be disengaged from the device once it has been placed on the user's foot, and a third position where the grip is moved away from the fixed handle which results in the sock mount moving distally on the shaft and pivots or rotating 180 degrees around the distal end of the shaft then moves to the back side of the shaft so that the device can be stored or so that the tongue is exposed on the front side of the device and can be used to remove the sock from the user's foot by inserting the tongue between the user's leg and sock and pushing the device toward the user's foot.

5. A device for pulling on and removing socks comprising:

a shaft having a distal end and an opposite proximal end, a flexible sock mount longitudinally movably relative to the distal end of the shaft and said sock mount pivotal 180 degrees relative to the distal end of the shaft, a tongue and an enclosure attached on the distal end of the shaft with a graduated gap formed therebetween into which the sock mount can be wedged when the sock mount is moved longitudinally relative to the distal end of the shaft in a proximal direction in order to hold a sock on the sock mount so the sock can be placed on a user's foot, a handle provided on the proximal end of the shaft, and a longitudinally movable grip provided on the proximal end of the shaft in relation to the handle, a hand operative control attached to the grip and extending between the grip and the sock mount for controlling longitudinal movement of the sock mount in response to movement of the grip.

6. A device for pulling on and removing socks according to claim 5 wherein said sock mount further comprises:

a base, upwardly curving tabs provided on each side of the base so that the tabs extend approximately perpendicular to the base, and a notch proved in each tab as a means for retaining a sock on the tabs.

7. A device for pulling on and removing socks according to claim 5 further comprising:

a grip provided on said hand operative control, and said grip movable between three positions.

8. A device for pulling on and removing socks comprising:

a shaft having a distal end and an opposite proximal end, a flexible sock mount longitudinally movably relative to and pivotally attached on the distal end of the shaft, a tongue and an enclosure attached on the distal end of the shaft with a graduated gap formed therebetween into which the sock mount can be wedged when moved longitudinally in a proximal direction in order to hold a sock on the sock mount so the sock can be placed on a user's foot, a handle provided on the proximal end of the shaft, and a longitudinally movable grip provided on the proximal end of the shaft in relation to the handle, a hand operative control attached to the grip and extending between the grip and the sock mount for controlling longitudinal movement of the sock mount in response to movement of the grip, a grip provided on said hand operative control, and said grip movable between three positions, a first position where the grip is moved fully proximally toward the fixed handle which results in wedging the sock mount and a sock placed thereon between a tongue and a rectangular enclosure which are attached at the distal end of the shaft to prepare the sock for placement on the user's foot, a second position where the grip is moved approximately half way between the first and third positions to a neutral disengaged position where the sock and sock mount are released from their wedged engagement between the tongue and the rectangular enclosure once the sock has been placed on the user's foot so that the sock can be disengaged from the device, and a third position where the grip is moved distally away from the fixed handle which results in the sock mount moving to the distal end of the shaft and rotates 180 degrees around the distal end and moves to the back side of the shaft for storage or so that the tongue located on the front side of the shaft is accessible and can be used to remove the sock from the user's foot by inserting the tongue between the user's leg and sock and pushing the device toward the user's foot.

9. A device for pulling on and removing socks according to claim 5 wherein the enclosure and the shaft are hollow so that the hand operative control extends through them.

10. A device for pulling on and removing socks comprising:

a shaft having a distal end and an opposite proximal end, a flexible sock mount longitudinally movably relative to and pivotally attached on the distal end of the shaft, a tongue and an enclosure attached on the distal end of the shaft with a graduated gap formed therebetween into which the sock mount can be wedged when moved longitudinally in a proximal direction in order to hold a sock on the sock mount so the sock can be placed on a user's foot, a handle provided on the proximal end of the shaft, a longitudinally movable grip provided on the proximal end of the shaft in relation to the handle, a hand operative control attached to the grip and extending between the grip and the sock mount for controlling longitudinal movement of the sock mount in response to movement of the grip, wherein the enclosure and the shaft are hollow so that the hand operative control extends through them, said enclosure provided with a longitudinal slit that extends through the enclosure and extends from front to back and around the distal end of the enclosure and, said sock mount pivotally attached to the hand operative control through the slit in the enclosure.

11. A device for pulling on and removing socks according to claim 5 wherein said tongue is shaped so that it can be used as a shoe horn to assist in inserting a foot into a shoe.

* * * * *